US010316813B2

(12) United States Patent
Florijancic et al.

(10) Patent No.: US 10,316,813 B2
(45) Date of Patent: Jun. 11, 2019

(54) SOLENOID DRIVE FOR A STARTER FOR AN INTERNAL COMBUSTION ENGINE

(71) Applicant: Mahle International GmbH, Stuttgart (DE)

(72) Inventors: Tadej Florijancic, Most na Soci (SI); Dejan Manfreda, Kal nad Kanalom (SI)

(73) Assignee: Mahle International GmbH (DE)

( * ) Notice: Subject to any disclaimer, the term of this patent is extended or adjusted under 35 U.S.C. 154(b) by 0 days.

(21) Appl. No.: 15/387,251

(22) Filed: Dec. 21, 2016

(65) Prior Publication Data

US 2017/0175696 A1 Jun. 22, 2017

(30) Foreign Application Priority Data

Dec. 22, 2015 (EP) ..... 15202072

(51) Int. Cl.
*H01H 67/02* (2006.01)
*F02N 15/06* (2006.01)
(Continued)

(52) U.S. Cl.
CPC ..... *F02N 15/067* (2013.01); *F02N 11/087* (2013.01); *H01F 7/081* (2013.01);
(Continued)

(58) Field of Classification Search
CPC ..... H01H 50/20; H01F 7/1607
(Continued)

(56) References Cited

U.S. PATENT DOCUMENTS 4,755,781 A * 7/1988 Bogner ..... H01H 51/065 335/126
4,902,904 A 2/1990 Isozumi
(Continued)

FOREIGN PATENT DOCUMENTS

CN 102693813 A 9/2012
DE 4117681 A1 12/1991
(Continued)

OTHER PUBLICATIONS

English abstract for DE-4442190.
(Continued)

*Primary Examiner* — Alexander Talpalatski
(74) *Attorney, Agent, or Firm* — Fishman Stewart PLLC

(57) ABSTRACT

A solenoid drive may include a ferromagnetic housing having a coil receiving chamber axially limited by opposing first and second face side walls, and a cylindrical coil arrangement having at least one electric coil, and being arranged in the coil receiving chamber and coaxially surrounding a cylindrical coil interior space. The solenoid drive may also include a ferromagnetic plunger stop having a central region projecting axially in the coil interior space, and a ferromagnetic plunger arranged at the housing opposing the plunger stop. The plunger may project axially into the coil interior space, and may be adjustable axially bidirectionally between an active position proximal to the central region and a passive position distal to the central region. The solenoid drive may further include a ferromagnetic bypass device arranged coaxially to the coil arrangement, radially within the at least one coil, and spaced apart axially from the face side walls.

14 Claims, 15 Drawing Sheets

(51) Int. Cl.

| | |
|---|---|
| ***H01F 7/16*** | (2006.01) |
| ***F02N 11/08*** | (2006.01) |
| ***H01F 7/08*** | (2006.01) |
| ***H01F 7/121*** | (2006.01) |
| ***H01H 51/06*** | (2006.01) |

(52) U.S. Cl.
CPC ..... *H01F 7/121* (2013.01); *H01F 7/1607* (2013.01); *H01H 51/065* (2013.01); *F02N 11/0851* (2013.01); *F02N 2015/061* (2013.01); *H01F 2007/163* (2013.01)

(58) Field of Classification Search
USPC ..... 335/126, 131; 251/129.15
See application file for complete search history.

(56) References Cited

U.S. PATENT DOCUMENTS

| | | | | |
|---|---|---|---|---|
| 4,990,874 | A * | 2/1991 | Shiroyama | F02N 11/00 335/126 |
| 5,118,960 | A | 6/1992 | Sasamoto et al. | |
| 6,392,516 | B1 * | 5/2002 | Ward | H01F 7/081 335/220 |
| 7,205,685 | B2 * | 4/2007 | Reichert | F16K 31/0624 310/14 |
| 7,852,178 | B2 * | 12/2010 | Bush | H01H 51/2209 335/126 |
| 8,222,980 | B2 * | 7/2012 | Yamagata | H01H 50/023 335/126 |
| 8,248,193 | B2 * | 8/2012 | Kaneda | F02N 15/067 335/126 |
| 8,421,565 | B2 | 4/2013 | Santichen et al. | |
| 9,793,079 | B2 * | 10/2017 | Kubono | H01H 51/04 |
| 9,799,474 | B2 * | 10/2017 | Sakai | H01H 50/026 |
| 2010/0271155 | A1 | 10/2010 | Kaneda et al. | |
| 2011/0025439 | A1 * | 2/2011 | Rettinger | H01F 7/081 335/278 |
| 2013/0284961 | A1 * | 10/2013 | Schnelker | F16K 31/0675 251/129.15 |
| 2015/0255235 | A1 * | 9/2015 | Nishimura | H01H 50/546 335/187 |
| 2016/0300676 | A1 * | 10/2016 | Sakai | H01H 50/026 |

FOREIGN PATENT DOCUMENTS

| | | | |
|---|---|---|---|
| DE | 4442190 | A1 | 5/1996 |
| DE | 102009052938 | A1 | 11/2010 |
| EP | 2858075 | A1 | 4/2015 |
| JP | 2002260512 | A | 9/2002 |
| WO | WO-2015072770 | A1 | 5/2015 |

OTHER PUBLICATIONS

English abstract for JP-2002260512.
German Search Report dated Feb. 15, 2017 in relation to German Application No. 10 2016 225 324.7.
English abstract for CN-102693813.

* cited by examiner

SOLENOID DRIVE FOR A STARTER FOR AN INTERNAL COMBUSTION ENGINE

CROSS-REFERENCE TO RELATED APPLICATION

This application claims priority to European Patent Application No. EP 15202072.2, filed on Dec. 22, 2015, the contents of which are incorporated by reference in its entirety.

TECHNICAL FIELD

The present invention relates to a solenoid drive for a starter of an internal combustion engine. The invention also relates to a starter for an internal combustion engine, which starter is equipped with such a solenoid drive.

BACKGROUND

A starter of this type comprises a support, an electric motor which is arranged on the support and which serves for driving a pinion in rotation, and a solenoid drive which is arranged on the support and which serves for the axial adjustment of the pinion between an engagement position, which is provided for the drive of a gearwheel of the internal combustion engine, and a non-engagement position, which is offset axially with respect to the engagement position.

The solenoid drive used here comprises a ferromagnetic housing and a cylindrical coil arrangement which has at least one electric coil, wherein the coil arrangement is arranged in the housing and coaxially surrounds a cylindrical coil interior space. Furthermore, a ferromagnetic plunger stop is provided which is arranged at a first axial end of the coil arrangement in the housing and which has a central region projecting axially into the coil interior space. Finally, a ferromagnetic plunger is provided which, at a second axial end of the coil arrangement, which axial end is opposite the central region of the plunger stop, projects axially into the coil interior space, and which is arranged so as to be adjustable axially bi-directionally relative to the housing between an active position which is proximal with respect to the central region and a passive position which is distal with respect to the central region. The drive coupling between plunger and pinion takes place in such a manner that, in the passive position of the plunger, the pinion is in the non-engagement position while said pinion is transferred into the engagement position thereof by adjustment of the plunger into the active position.

For the starting of the internal combustion engine, the solenoid drive is activated so as to transfer the pinion of the starter from the non-engagement position into the engagement position. For this purpose, the plunger is adjusted from the passive position into the active position. In the engagement position, the pinion meshes with a gearwheel of the internal combustion engine, which may be formed for example on a flywheel of a drive train of the internal combustion engine. The electric motor then drives the pinion, which in turn drives said gearwheel, as a result of which a crankshaft of the internal combustion engine is set into rotation in order to start the internal combustion engine. As soon as the internal combustion engine has started and the crankshaft thereof is driven by reciprocating movements of pistons of the internal combustion engine, the solenoid drive is activated such that the pinion is returned again from the engagement position into the non-engagement position. For this purpose, the plunger is adjusted back from the active position into the passive position. In the non-engagement position, the pinion disengages from said gearwheel, that is to say no longer meshes with the latter.

In order to be able to adjust the pinion from the non-engagement position into the engagement position and in order to be able to secure the pinion in the engagement position, the coil arrangement has to transmit comparatively large electromagnetic forces to the plunger in order to draw the latter into the coil interior space and hold said plunger therein, for the active position. Since, for the purposes of a failsafe design, the plunger is preferably drawn into the coil interior space counter to the action of a restoring spring, comparatively high magnetic forces are required in particular to hold the plunger static in the active position, and therefore the coil arrangement is supplied with a correspondingly high level of electrical power.

The pinion normally has a circumferential toothing with axially extending teeth. Complementary with respect thereto, the gearwheel of the internal combustion engine likewise has a circumferential toothing with axially running teeth. Upon a transfer of the pinion from the non-engagement position into the engagement position, the teeth of the pinion engage in toothed spaces of the gearwheel. However, in many situations, axially leading tooth flanks of the teeth of the pinion do not pass directly into the toothed spaces of the toothing of the gearwheel but strike against axial tooth flanks of the teeth of the gearwheel. In order that the teeth of the pinion nevertheless find the toothed spaces of the gearwheel and can engage therein, the electric motor of the starter may be activated so as to effect a rotation of the pinion as early as during the adjustment of the pinion from the non-engagement position into the engagement position. Said rotation for the threading-in of the pinion into the gearwheel is expediently performed with a considerably reduced torque and/or with a considerably reduced rotational speed in relation to the subsequent starting operation, when the pinion is fully engaged with the gearwheel.

For said two-stage starting operation, which may also be referred to as "soft-start", in the case of a starter of this type an electric series connection of the electric motor and of the solenoid drive is expediently proposed, and therefore, for the reduced driving of the electric motor, the voltage provided for energising the coil arrangement can be used in conjunction with the associated current. The solenoid drive then serves at the same time as a switch for connecting the electric motor to the actual motor current supply. In this respect, the solenoid drive at the same time forms an electromagnetic switch.

Owing to the above-described, comparatively high magnetic force with which the plunger is drawn into the coil interior space, the pinion may, by way of the axially leading tooth flanks thereof, collide with the opposite axial tooth flanks of the gearwheel with corresponding intensity, increasing the wear of the toothings of pinion and gearwheel. Furthermore, the toothings may bear against one another via the axial tooth flanks with a comparatively high force, as a result of which a correspondingly high level of friction has to be overcome in order to rotate the pinion relative to the gearwheel such that the toothing of the pinion can mesh with the toothing of the gearwheel. As a result, there is the risk of increased wear here too.

A starter of this type is known, for example, from U.S. Pat. No. 8,421,565 B2. To solve the above mentioned problem, in the case of the starter, said document proposes a complex construction of the coil arrangement within the solenoid drive, wherein a retraction coil for pulling the plunger into the coil interior space and a holding coil for holding the plunger that is being pulled into the coil interior space are arranged axially separately from one another. It is also proposed that the plunger be equipped, on the outer circumference thereof, with an encircling annular groove which, in the passive position, is situated radially opposite an edge region circumferentially surrounding a passage opening, through which the plunger passes axially, of an end side wall of a solenoid housing. In this way, in the passive position, there is a radial gap between plunger and edge region. As the plunger is retracted into the coil interior space, the circumferential groove moves into the coil interior space and thereby departs from the above mentioned edge region of the end side wall, such that said edge region is subsequently situated radially opposite a plunger longitudinal section axially adjoining the circumferential groove. As the plunger is retracted, therefore, a radial distance between said edge region and an outer side of the plunger is varied, specifically reduced, as a result of which the density of the magnetic field lines transmitted from said edge region to the plunger when the coil arrangement is switched on, is varied, specifically increased. However, the density of the magnetic field lines correlates with the acting magnetic forces. The circumferential groove formed on the plunger thus yields a reduction in the acting magnetic forces at the start of the retraction movement of the plunger when the pinion is to be transferred from the non-engagement position into the engagement position. Said known measures are, however, relatively cumbersome to realise. Furthermore, the attractive force that pulls the plunger into the coil interior space is reduced only to a comparatively small extent by the annular groove, since said annular groove ultimately merely effects a deflection of the field lines. Also, the annular groove is maintained and, even when the plunger has been retracted into the coil interior space, causes a deflection of the field lines in the plunger, thus reducing the attainable magnetic forces.

DE 10 2009 052 938 A1 discloses another solution to this problem. In this document, the solenoid drive, which is referred to as an electromagnetic switch, is equipped with a ferromagnetic bypass device, which, when the coil arrangement is energized, diverts some of the magnetic field lines directly from the plunger into the plunger stop, at least in the passive position of the plunger, such that said field lines do not extend through an air gap formed axially between the plunger and the plunger stop. Since, however, the field lines extending through said air gap are crucial for the magnetic force which drives the plunger into the coil interior space, the force acting on the plunger may be reduced for the beginning of the adjustment movement. With increasing penetration depth of the plunger into the coil interior space, the diversion of the magnetic field lines by the bypass device is reduced, as a result of which the magnetic force driving the plunger increases. It has even been shown that, in the active position, the magnetic holding force which holds the plunger in the active position can be increased with the aid of such a bypass device. The same then holds true for the forces which act on the pinion and drive the pinion from the non-engagement position into the engagement position and optionally hold said pinion therein. In this known configuration a part of the magnetic flux is bypassing the axial gap between plunger and plunger stop by passing directly from the housing via the bypass device to the plunger stop. Therefore, the exact axial position of the bypass device relative to the housing and relative to the plunger stop is essential for the deviating effect. Accordingly, narrow production tolerances have to be used.

In the case of the known solenoid drive, the bypass device is formed by a ferromagnetic annular body which is dimensioned and arranged in the coil interior space in such a manner that said annular body extends as far as the second axial end of the coil arrangement and is supported there preferably on the housing and is in contact therewith.

SUMMARY

The present invention is concerned with the problem of specifying, for a solenoid drive of the type mentioned in the introduction or for a starter equipped therewith, an improved or at least different embodiment which is characterized by a simplified construction and capability of being realised inexpensively. At the same time, the intention is furthermore to ensure reduced wear of the pinion and/or of the gearwheel that interacts therewith. In particular, the intention is to specify an advantageous or alternative way of reducing the acting magnetic forces at the start of the adjustment of the pinion from the non-engagement position into the engagement position.

This problem is solved according to the invention by the features of the independent claims. The dependent claims relate to advantageous embodiments.

The invention is based, according to a first solution, on the general concept of dimensioning and arranging the bypass device in such a manner that said bypass device is spaced apart axially from both axial face side walls axially limiting a coil receiving chamber in which the coil arrangement is arranged. Therefore, the bypass device does not come into contact with the housing and the plunger stop for the deflection of the magnetic field lines. The invention makes use of the finding that for the purpose of deviating the magnetic field lines the bypass device does not need to come into contact with the housing at the face side wall which is in proximity of the plunger. In the invention a part of the magnetic flux is bypassing the axial gap between plunger and plunger stop by passing directly from the plunger via the bypass device to the plunger stop. The exact axial position of the bypass device relative to said face side wall of the housing is therefore not essential for the deviating effect. Consequently, relatively broad production tolerances can be used. This simplifies the production of the solenoid drive and reduces the production costs. Furthermore, the bypass device can thereby also be of smaller dimensions, as a result of which said bypass device is less expensive.

In particular, the dimensioning and arrangement of the bypass device are undertaken in such a manner that a plunger end side facing the central region of the plunger stop is positioned axially within the bypass device in the passive position while said plunger end side is adjusted axially beyond the bypass device in the direction of the central region in the active position. In particular, the plunger end side is then located axially between the plunger stop and the bypass device. Preferably, the separate bypass device and the coil arrangement are arranged in the coil receiving chamber.

Preferably, the plunger stop comprises the first face side wall coaxially surrounding the central region, wherein the second face side wall is provided at the housing coaxially surrounding the plunger. This simplifies the manufacture of the solenoid drive.

In another advantageous embodiment, the bypass device can be dimensioned in such a manner that said bypass device is at a respective axial distance from both face side walls, which axial distance is at least 20% of an axial length of the coil receiving chamber. The axial length of the coil receiving chamber corresponds here to the axially measured distance between the two face side walls which axially limit the coil receiving chamber. The axial distances are preferably in each case approximately 25% of the axial length of the coil receiving chamber. Accordingly, the bypass device expediently has an axial length of approximately 50% of the axial length of the coil receiving chamber. Furthermore, it can be provided additionally or alternatively that the bypass device is arranged substantially centrally axially in or with respect to the coil receiving chamber. In this case, the axial distances of the bypass device from both face side walls are approximately equal in size. This symmetrical arrangement simplifies the production and the installation of the coil arrangement with the bypass device within the coil receiving chamber.

According to another advantageous embodiment, the coil arrangement can have a cylindrical coil carrier onto which the at least one coil of the coil arrangement is wound radially on the outside. The coil carrier can have, radially on the inside, a receiving region in which the bypass device is arranged. By this means, the coil carrier can be used at the same time as support for the bypass device. In particular, it is therefore possible to provide an assembly which can be preassembled outside the housing and can then be uniformly inserted into the housing.

According to an advantageous development, the receiving region can be dimensioned in such a manner that said receiving region substantially extends only over the axial length of the bypass device. The bypass device is therefore fitted preferably exactly into the coil carrier. In particular, the plastics coil carrier can be injected onto the bypass device.

Alternatively, the receiving region can also be dimensioned in such a manner that said receiving region extends axially as far as one of the axial ends of the coil arrangement, expediently as far as the second axial end. The bypass device can be positioned here axially in the receiving region by means of a positioning ring which extends from the bypass device as far as said axial end of the coil arrangement and which is non-magnetic. In the present context, the term "non-magnetic" is understood as meaning "not magnetic and/or not magnetisable". A non-magnetic material is accordingly not magnetic and/or not magnetisable. A non-magnetic material is, for example, a plastic. The non-magnetic positioning ring can accordingly be, for example, a plastics component.

In an advantageous development, said positioning ring can form, radially on the inside, a cylindrical guide contour on which the plunger is guided in an axially adjustable manner radially on the outside. By this means, the positioning ring obtains a dual function. In particular, a separate guide sleeve for guiding the plunger can be dispensed with. The plunger is in contact with the guide contour of the positioning ring while a radial distance is maintained radially between the bypass device and the plunger.

Instead of a positioning ring for positioning the bypass device in the receiving region, it is also possible to realise a latching with brings about an axial fixing of the bypass device when the latter has reached the position provided therefor in the receiving region on the coil carrier.

In another embodiment, the bypass device can be arranged radially on the inside of the coil carrier axially between two positioning rings which each extend from the bypass device as far as one of the axial ends of the coil arrangement. Said positioning rings are expediently also non-magnetic, and therefore the magnetic deflecting function is realised only by the bypass device. In this embodiment, the production of the coil carrier is simplified since said coil carrier does not have to have any receiving region on the inside and therefore can be designed without steps. The one positioning ring can be supported axially on the plunger stop while the other positioning ring can be supported axially on the housing.

In another embodiment or in another solution according to the invention, which can also be realised independently of the solution described above and accordingly represents an independent solution of the problem mentioned at the beginning, the bypass device can be formed by an integral component of the housing, which component is of cylindrical or sleeve-shaped design and which extends coaxially into the coil interior space at the second axial end of the coil arrangement. In this case, the bypass device is therefore not realised in the form of a separate component, but rather by said cylindrical sleeve section of the housing. This approach reduces the production costs and simplifies the assembly.

According to an advantageous development, the coil carrier can have an annular step with which said coil carrier is plugged axially onto the bypass device formed by the sleeve section. In this case, the bypass device can therefore the used as an assembly aid for the coil arrangement.

In another embodiment or in another solution according to the invention, which can also be realised independently of the solutions described above and accordingly represents an independent solution of the problem mentioned at the beginning, the bypass device can have at least one winding made from a ferromagnetic wire, or can be formed therefrom. In particular, the bypass device can thereby be integrated particularly simply into the coil arrangement. For example, the winding of the bypass device can be wound onto the coil carrier, onto which the at least one coil of the coil arrangement is also wound. By this means, the coil arrangement with integrated bypass device can be produced particularly inexpensively.

In another embodiment or in another solution according to the invention, which can also be realised independently of the solutions described above and accordingly represents an independent solution of the problem mentioned at the beginning, the bypass device can have a plurality of bypass elements which are distributed in the circumferential direction and are made from ferromagnetic material. By means of the use of a plurality of bypass elements distributed in the circumferential direction, instead of an encircling, undivided annular body which is closed in the circumferential direction, the influence of the bypass device on the field lines can be varied. In particular, particularly fine coordination can thereby be realised. The bypass elements can be arranged in an annular support of the bypass device, which simplifies the handling of the bypass device despite there being a plurality of separate bypass elements. It is also conceivable to arrange the individual bypass elements on the coil carrier, either radially on the inside in a corresponding receiving region or radially on the outside in the region of the at least one coil. The bypass elements can directly adjoin one another in the circumferential direction such that said bypass elements together again form a closed ring which is, however, divided or segmented. Alternatively, the individual bypass elements can also be arranged spaced apart from one another in the circumferential direction.

In an advantageous embodiment, the plunger can be guided in an axially adjustable manner radially on the outside of a cylindrical guide sleeve which is arranged coaxially on the inside of the coil arrangement and which extends from the first axial end through the coil interior space and beyond the second axial end into a guide region of the housing, through which guide region the plunger passes With the aid of a guide sleeve of this type, precise axial guidance for the plunger can be realised, as a result of which the solenoid drive has increased functional reliability.

In another embodiment or in another solution according to the invention, which can also be realised independently of the solutions described above and accordingly represents an independent solution of the problem mentioned at the beginning, the above mentioned guide sleeve can be composed of a ferromagnetic material and the bypass device can be formed by an integral component of the guide sleeve. In this respect, the guide sleeve obtains a dual function since said guide sleeve also serves at the same time as the bypass device. This measure also simplifies the production and reduces the costs.

In another embodiment or in another solution according to the invention, which can also be realised independently of the solutions described above and accordingly represents an independent solution of the problem mentioned at the beginning, the bypass device can form, radially in the inside, a cylindrical guide contour on which the plunger is guided in an axially adjustable manner radially on the outside. By this means, the bypass device obtains a dual function. In particular, a separate guide sleeve of the type described above can be dispensed with here.

In another embodiment or in another solution according to the invention, which can also be realised independently of the solutions described above and accordingly represents an independent solution of the problem mentioned at the beginning, the bypass device can have, in the coil interior space, a cylindrical, ferromagnetic deflecting body which is supported axially on the central region of the plunger stop via a cylindrical, non-magnetic spacer body. In comparison to a conventional construction, the bypass device is thereby offset radially inward into the coil interior space, as a result of which it is possible in particular to use the coil arrangement unchanged, which simplifies the realisation of the solenoid drive presented here.

According to an advantageous development, the deflecting body and the spacer body can be of hollow-cylindrical or annular design and can be arranged in the coil interior space radially on the outside with respect to the plunger. The plunger therefore protrudes into the annular deflecting body and into the annular spacer body during the adjustment from the passive position into the active position.

Alternatively thereto, the plunger can be of hollow-cylindrical design at least in an end region facing the central region of the plunger stop and can have a cylindrical plunger wall enclosing a plunger interior space. In this case, the deflecting body and the spacer body can be arranged radially on the inside with respect to said plunger wall. In other words, during the adjustment of the plunger from the passive position into the active position, deflecting body and spacer body protrude axially into the hollow-cylindrical end region of the plunger. This embodiment also leads to a particularly compact construction.

In another advantageous development, a restoring spring which drives the plunger into the passive position can be supported on the deflecting body. By this means, the deflecting body serves as an abutment for the restoring spring and thereby has an additional function.

The solenoid drive can be equipped with an actuating rod which is connected in terms of drive to the plunger and which is guided axially through the plunger stop. On a side of the plunger stop facing away from the coil interior space, said actuating rod bears an electrically conductive contact plate, with the aid of which, in the active position of the plunger, two electric contacts are connected in an electrically conductive manner to each other for example in order to connect the electric motor of the starter to the main current supply thereof. The contact plate and the contacts therefore form a switch within the solenoid drive, and therefore the entire solenoid drive may also be referred to as an electromagnetic switch.

A starter according to the invention for an internal combustion engine comprises a support, an electric motor which is arranged on the support and serves for driving a pinion in rotation, and a solenoid drive of the type described above which is arranged on the support and serves for the axial adjustment of the pinion between an engagement position, which is provided for the drive of a gearwheel of the internal combustion engine, and a non-engagement position, which is offset axially with respect to the engagement position.

Further important features and advantages of the invention will emerge from the dependent claims, from the drawings and from the associated description of the figures with reference to the drawings.

It is self-evident that the features mentioned above and the features yet to be explained below can be used not only in the respectively stated combination, but also in other combinations or individually, without departing from the scope of the present invention.

Preferred exemplary embodiments of the invention are illustrated in the drawings and will be explained in more detail in the description below, wherein the same reference signs relate to identical or similar or functionally identical components.

BRIEF DESCRIPTION OF THE DRAWINGS

In the drawings, in each case schematically.

DETAILED DESCRIPTION

Figure 1:
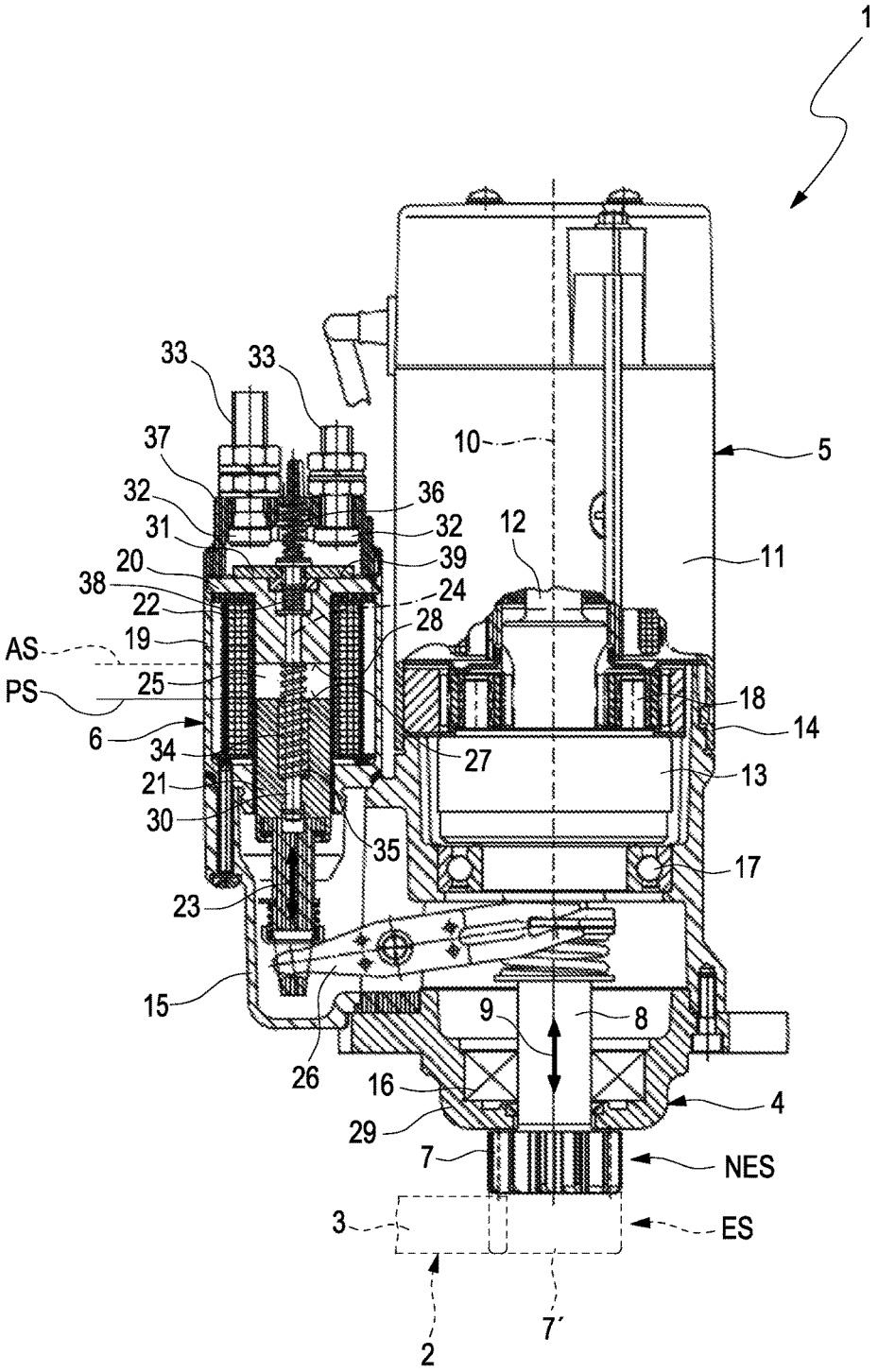
FIG. 1 shows a side view with a partial longitudinal section of a starter with a conventional solenoid drive.

According to FIG. 1, a starter 1 which is provided for starting an internal combustion engine 2, of which only a gearwheel 3 is indicated in FIG. 1 by dashed lines, comprises a support 4, an electric motor 5 and a solenoid drive 6, which serves at the same time as a switch for actuating the electric motor 5. The gearwheel 3 is incorporated in a suitable manner into a drive train (not shown specifically here) of the internal combustion engine 2 such that said gearwheel is connected in terms of drive to a crankshaft of the internal combustion engine 2 if the internal combustion engine 2 is, as is preferred, a piston engine with a crankshaft. For example, the gearwheel 3 may be formed on a flywheel of the drive train.

The support 4 is designed for fastening the starter 1 to the internal combustion engine 2 or to a peripheral of the internal combustion engine 2 which may be located, for example, in a vehicle which is equipped with the internal combustion engine 2.

The electric motor 5 is arranged on the support 4 and serves for driving a pinion 7 in rotation. The pinion 7 serves for driving the gearwheel 3 when the internal combustion engine 2 is intended to be started with the aid of the starter 1. For this purpose, the pinion 7, together with a drive shaft 8 on which the pinion 7 is arranged for conjoint rotation therewith, is adjustable bilinearly in an axial direction 9, which is defined by an axis of rotation 10 of the drive shaft 8 or of the electric motor 5, between a non-engagement position NES, which is shown in FIG. 1 by solid lines, and an engagement position ES, which is indicated in FIG. 1 by dashed lines. In said engagement position ES, the pinion is assigned the reference sign 7'. In the engagement position ES, the pinion 7' serves for driving the gearwheel 3 and thus meshes with the latter such that a rotation of the pinion 7' forces a rotation of the gearwheel 3. In the non-engagement position NES, the pinion 7 is axially offset with respect to the engagement position ES, specifically to such an extent that said pinion does not mesh with the gearwheel 3. In this respect, the pinion 7 is then arranged axially spaced apart from the gearwheel 3.

The electric motor 5 furthermore has, in the conventional manner, an external stator 11 and an internal rotor 12, wherein the rotor 12 is connected in terms of drive to the drive shaft 8 via a transmission device 13. The transmission device 13 may have a clutch, in particular a one-way friction clutch. The transmission device 13 may additionally or alternatively have a gearing 18, for example a planetary gearing. The stator 11 is accommodated in a stator housing 14 which is fastened to the support 4. In the situation shown, the support 4 has a base housing 29, which serves for the fastening of the starter 1 to said peripheral, and an intermediate housing 15, which is fastened to the base housing 29. In the example shown, the stator housing 14 is now fastened to said intermediate housing 15.

The drive shaft 8 is mounted by way of a main bearing 16 on the support 4 or on the base housing 29 thereof. A further bearing 17 is provided in the intermediate housing 15, for the purpose of mounting the drive shaft 8.

The solenoid drive 6 has a solenoid housing 19 which is referred to below in short as housing 19 and which is fastened to the support 4, specifically to the intermediate housing 15 thereof. The solenoid drive 6 serves for the axial adjustment of the pinion 7. For this purpose, the solenoid drive 6 has a plunger stop 20 which is static with respect to the support 4, a plunger 21 which is axially adjustable relative to the plunger stop 20, and a cylindrical coil arrangement 22. An axial direction 23 of the axial adjustability of the plunger 21 is defined by a longitudinal central axis 24 of the solenoid drive 6. The solenoid drive 6 is expediently arranged on the support 4 so as to be parallel and adjacent to the electric motor 5, such that the longitudinal central axis 24 extends parallel to the axis of rotation 10.

The coil arrangement 22 is arranged on the plunger stop 20 and surrounds a cylindrical coil interior space 25 in a circumferential direction, which is based on the longitudinal central axis 24. The plunger 21 is coupled by way of a deflecting lever 26 to the drive shaft 8 in such a manner that, for the adjustment of the pinion 7 from the non-engagement position NES into the engagement position ES, the plunger 21 is retracted into the coil interior space 25. Accordingly, the coil arrangement 22 is in the form of a retraction coil 40 which, when energised, pulls the plunger 21 into the coil interior space 25. The deflecting lever 26 here effects a reversal of the movement direction, such that the retraction of the plunger 21 toward the top in FIG. 1 effects a deployment of the pinion 7 toward the bottom in FIG. 1. The plunger 21 is therefore adjustable with respect to the plunger stop 20 between an extended passive position PS and a retracted active position AS. In FIG. 1, the axial position of a plunger end side 27 facing the plunger stop 20 is indicated by solid lines for the passive position PS while the axial position of the plunger end side 27 is indicated by dashed lines for the active position AS. In the active position AS, the plunger end side 27 preferably comes axially to bear against a stop end side 28 of the plunger stop 20, which stop end side faces the plunger 21 and therefore forms an axial end stop for the plunger 21.

In addition, the plunger 21 is coupled to an actuating rod 30 which, for this purpose, extends at least partially through the plunger 21. The actuating rod 30 serves for the axial adjustment of a plate-like contact element 31 which, for its part, serves for the electrical connection of two electric contacts 32. The electric motor 5 is connected to a main current supply 33 via said electric contacts 32. In other words, as soon as the contact element 31 electrically connects the two electric contacts 32 to each other, the electric motor 5 can be supplied with a rated electrical power via the main current supply 33 so that the electric motor 5 can output a rated torque at the pinion 7. In order to realise what is referred to as a "soft-start operation", provision may be made to connect the electric motor 5 in series with the solenoid drive 6 or with the coil arrangement 22 thereof. The electric motor 5 can therefore be initially supplied with a considerably lower electrical power in order to drive the pinion 7 with a considerably lower torque and/or at a considerably lower rotational speed for as long as said pinion has not yet reached the engagement position ES thereof.

The actuating rod 30 is guided coaxially through the plunger stop 20. Accordingly, the plunger stop 20 is ultimately located axially between the plunger 21 and the contact element 31. The plunger 21 is assigned at least one restoring spring 34 which, in the example, loops coaxially around the actuating rod 30. The restoring spring 34 is supported here on one side on the plunger 21 and on the other side on the plunger stop 20. The restoring spring 34 protrudes here in a cavity 35 formed on the plunger 21.

The actuating rod 30 is also assigned a restoring spring 36 which is supported on one side on the actuating rod 30 and on the other side on a contact housing 37, on which the electric contacts 32 are located. Furthermore, a pre-tensioning spring 38 can be provided which drives the contact element 31 in the direction of the contacts 32. Said pre-tensioning spring 38 is supported here on the actuating rod 30. An axial distance between the contact element 31 and the contacts 32 is discernibly smaller than the entire adjustment travel of the plunger 21 between the passive position PS and the active position AS. The contact element 31 therefore comes into contact with the contacts 32 shortly before reaching the active position AS. On reaching the active position AS, the pre-tensioning spring 38 then brings about a pre-tensioned bearing of the contact element 31 against the contacts 32. By means of the capacitive effect of coils/windings of the electric motor 5, the rated torque builds up with a time delay. The coordination is expediently undertaken here in such a manner that the rated torque is present approximately synchronously with the reaching of the active position AS, i.e. also synchronously with the reaching of the engagement position ES.

Furthermore, it can be seen that, in the passive position PS, the contact element 31 bears axially against a rear side 39 of the plunger stop 20, which rear side faces away from the plunger 21.

Since the solenoid drive 6 therefore also serves for the connection of the main current supply 33 of the electric motor 5, said solenoid drive may also be referred to as an electromagnetic switch.

According to FIGS. 2 to 15, the solenoid drive 6 comprises the housing 19 produced from a ferromagnetic material, the coil arrangement 22, the ferromagnetic plunger stop 20 and the ferromagnetic plunger 21. In the examples shown here, the coil arrangement 22 in each case comprises two coils, specifically a retraction coil 40 for pulling the plunger 21 into the interior of the coil arrangement 22 counter to the plunger stop 20, and a holding coil 41 for holding the plunger 21 in the active position AS. The coil arrangement 22 is arranged in a coil receiving chamber 72 of the housing 19 and coaxially surrounds the coil interior space 25. The coil receiving chamber 72 is axially limited by a first face side wall 73 and a second face side wall 74 axially opposing the first face side wall 73.

The plunger stop 20 is arranged at a first axial end 42 of the coil arrangement 22 in the housing 19. The plunger stop 20 has a central region 43 which projects axially into the coil interior space 25 and has the above mentioned stop end side 28 which can serve as an axial stop for the plunger 21. The plunger stop 20 is provided with the first face side wall 73 which is ring shaped and coaxially encircling the central region 43. The second face side wall 74 is provided at the housing 19. In the depicted examples, the coil arrangement 22 axially abuts with its first axial end 42 to the first face side wall 73.

The plunger 21 projects axially into the coil interior space 25 at a second axial end 44 of the coil arrangement 22, which second axial end 44 is opposite the central region 43. In the depicted examples, this second axial end 44 is axially spaced apart from the second face side wall 74. Thus an axial gap 75 is provided axially between the second axial end 44 and the second face side wall 74.

Furthermore, the plunger 21, as explained, is arranged so as to be adjustable axially bi-directionally relative to the housing 19 between the active position AS which is proximal with respect to the central region 43 and the passive position PS which is distal with respect to the central region 43. In the passive position PS an axial air gap 71 is provided within the coil interior space 25 axially between the plunger 21 or the plunger end side 27, respectively, and the plunger stop 20 or the stop end side 28, respectively. This axial air gap 71 reduces when the plunger 21 moves from the passive position PS to the active position AS. As explained, in the active position AS, the plunger 21 can be in contact by means of the plunger end side 27 thereof with the stop end side 28 which is located on the central region 43 in the coil interior space 25. In this case the axial air gap 71 is eliminated in the active position AS.

In addition, the solenoid drive 6 shown here is equipped with a ferromagnetic bypass device 45. The latter is arranged within the coil receiving chamber 72, coaxially with respect to the coil arrangement 22 and radially within the respective coil 40, 41 of the coil arrangement 22. In a starting region of the adjustment travel of the plunger 21, which starting region has the passive position PS, the bypass device 45 brings about a deflection of magnetic field lines in such a manner that the deflected magnetic field lines are not guided within the coil interior space 25 through the axial air gap 71 prevailing there between plunger 21 and plunger stop 20, but rather pass from the plunger 21 via the bypass device 45 directly to the plunger stop 20. This results in a reduction in the magnetic forces which drive the plunger 21 in the coil interior space 25 in the direction of the plunger stop 20. With increasing penetration depth of the plunger 21 into the coil arrangement 22, said deflecting influence of the bypass device 45 decreases. In particular, the field lines run substantially directly within the reduced air gap 71 from the plunger 21 to the plunger stop 20 in an end region of the adjustment travel of the plunger 21, which end region contains the active position AS.

Figure 2:
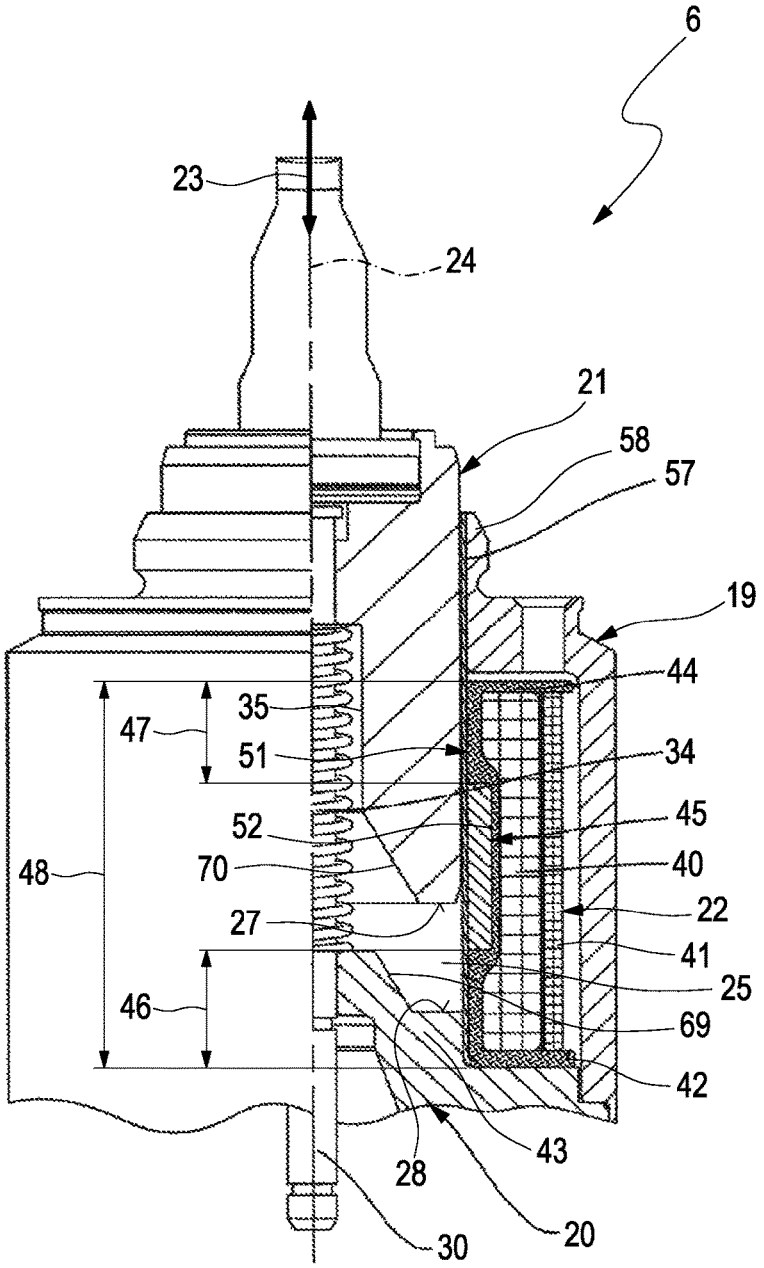
FIG. 2 shows a side view with half a longitudinal section of a solenoid drive according to the invention in the region of a bypass device.

In the embodiments of FIGS. 2 to 5, 7 to 10 and 13 to 15, the bypass device 45 is arranged and dimensioned in such a manner that said bypass device 45 is spaced apart axially from both face side walls 73, 74 of the coil receiving chamber 72 and also from both axial ends 42, 44 of the coil arrangement 22. According to FIG. 2, the bypass device 45 can be at a respective axial distance 46, 47 from both face side walls 73, 74, which axial distance is at least 20% of an axial length 48 of the coil receiving chamber 72. The axial length 48 of the coil receiving chamber 72 is discernibly defined by the axial distance between the two face side walls 73, 74. In the example of FIG. 2, the bypass device 45 is arranged approximately centrally axially with respect to the coil receiving chamber 72.

In the examples of FIGS. 2 to 6 and 9 to 15, the bypass device 45 is formed in each case by a single cylindrical and preferably annular body. By contrast, in the case of the embodiment shown in FIG. 7, the bypass device 45 is formed by a winding 49 made from a ferromagnetic wire. In the case of the embodiment shown in FIG. 8, the bypass device 45 is formed with the aid of a plurality of ferromagnetic bypass elements 50 which are arranged distributed in the circumferential direction. The bypass elements 50 can be adjacent to one another in the circumferential direction or preferably arranged spaced apart from one another.

In all of the embodiments shown here, the coil arrangement 22 has a cylindrical coil carrier 51 onto which the two coils 40, 41 are wound radially on the outside. The holding coil 41 is expediently wound here radially on the outside of the retraction coil 40 and extends in particular over the entire axial length of the retraction coil 40. The coil carrier 51 is expediently composed of a non-magnetic material. In particular, the coil carrier 51 has a tubular casing (not denoted specifically) which, at the axial ends thereof, has two annular end discs which protrude outward from the casing in the manner of collars and define the axial ends 42, 44 of the coil arrangement 22. The coils 40, 41 are arranged radially on the outside of the casing and axially between the end discs.

The bypass device 45 can now be arranged radially on the inside of the coil carrier 51, which is the case in the examples of FIGS. 2 to 6 and 9 to 13. In particular, for this purpose, a receiving region 52 which forms a depression on the inner side of the coil carrier 51 can be formed radially on the inside of the coil carrier 51. The bypass device 45 is inserted in said recessed receiving region 52. A receiving region 52 of this type can be seen, for example, in the embodiments of FIGS. 2 to 4. In the example of FIG. 2, the receiving region 52 extends axially only over the axial length of the bypass device 45. For example, the coil carrier 51 which is produced from a plastic can be sprayed or injection moulded onto the outside of the bypass device 45.

Figure 3:
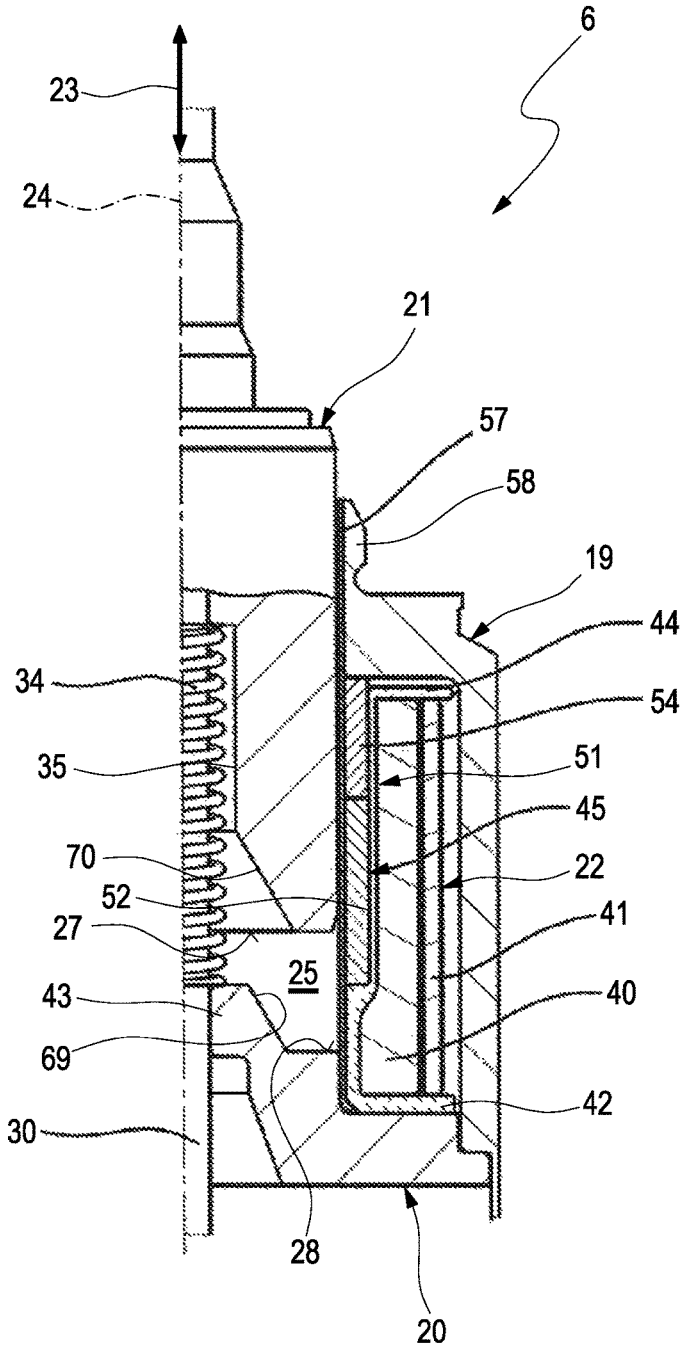
FIGS. 3 to 15 show half longitudinal sections as in FIG. 2, but for various other embodiments.
Figure 4:
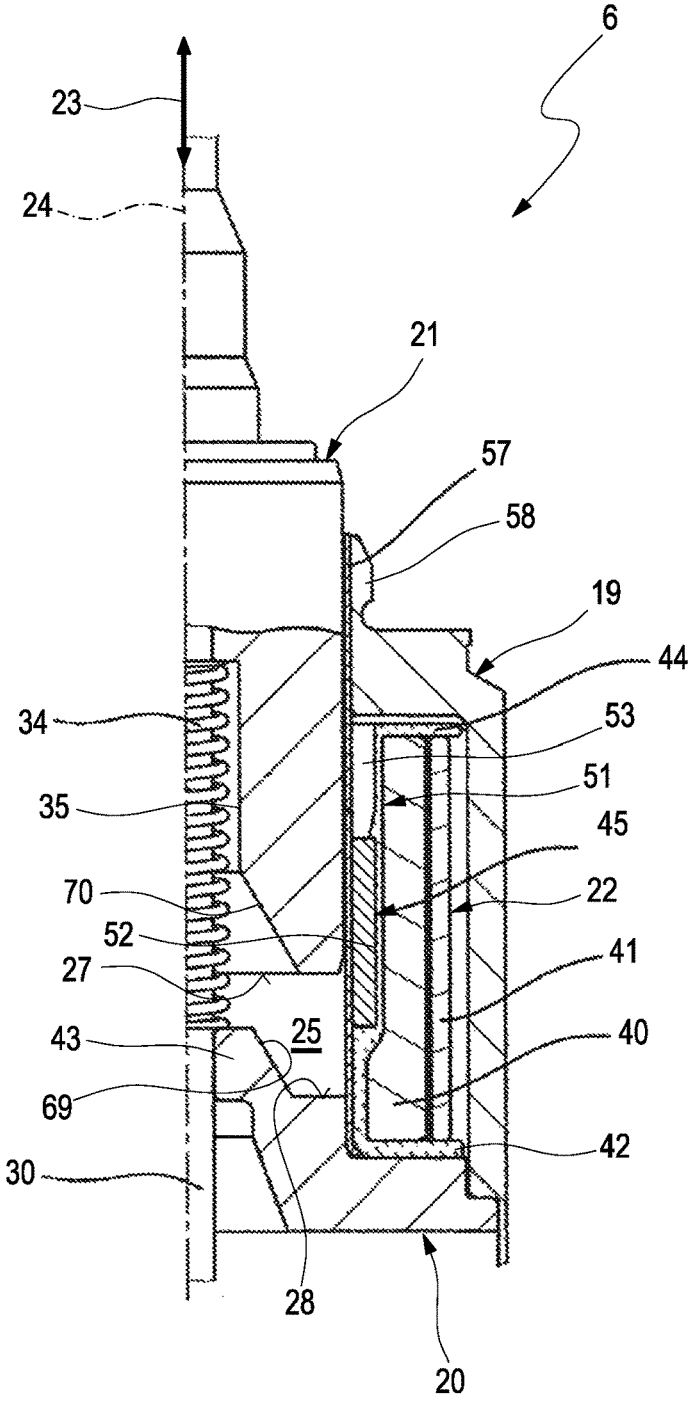

In the examples of FIGS. 3 and 4, the receiving region 52 is, by contrast, dimensioned in such a manner that said receiving region extends axially as far as one of the axial ends 42, 44, here as far as the second axial end 44. In the example of FIG. 3, the bypass device 45 is positioned axially in the receiving region 52 with the aid of a positioning ring 54. The positioning ring 54 is non-magnetic and extends from the bypass device 45 as far as said second axial end 44. For example, the positioning ring 54 is supported axially on the second face side wall 74 of the housing 19. In the example of FIG. 4, a latching 53 is provided for the axial fixing of the bypass device 45. An individual latching lug which is latched to an axial end side of the bypass device 45 is shown. A plurality of latching lugs of this type can be arranged distributed in the circumferential direction. It is likewise conceivable to provide a latching contour encircling in the circumferential direction.

Figure 5:
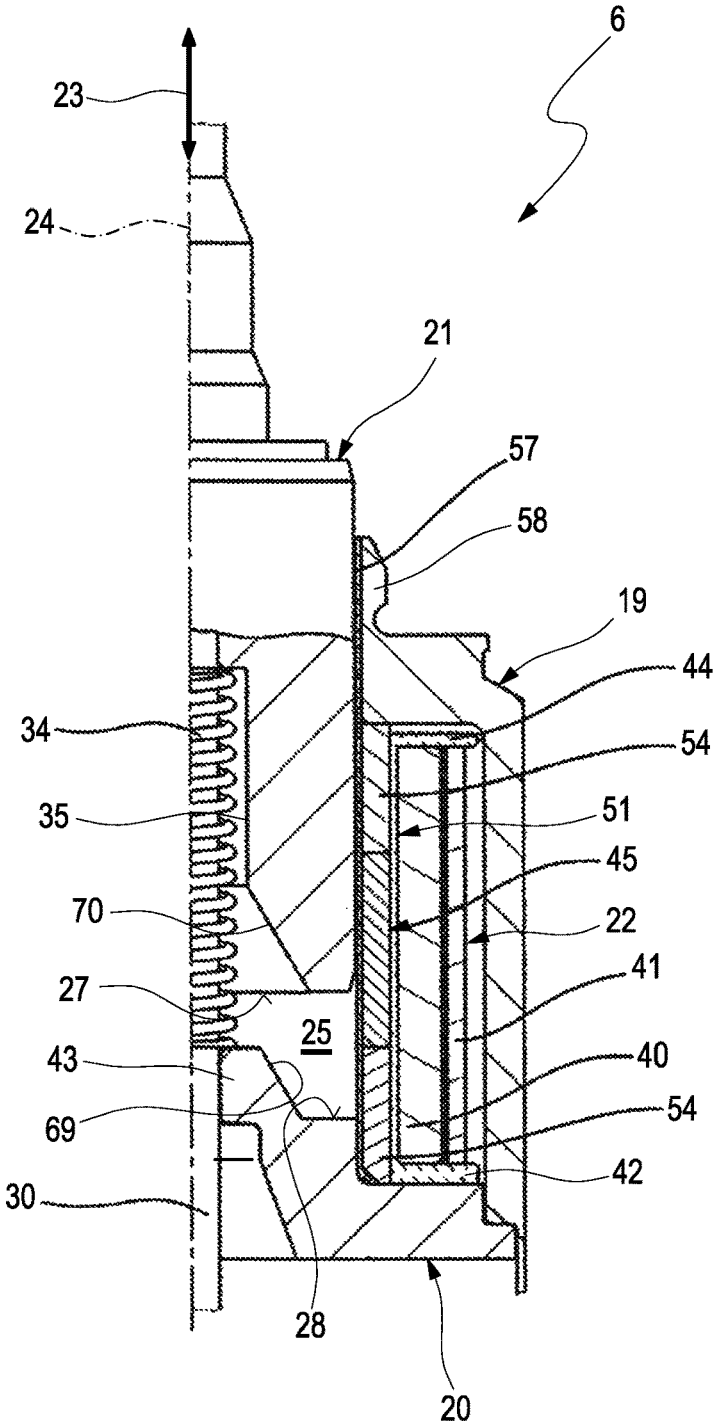

FIG. 5 shows an embodiment in which the bypass device 45 is positioned axially radially on the inside of the coil carrier 51 with the aid of two positioning rings 54. For this purpose, the bypass device 45 is arranged axially between the two positioning rings 54. The respective positioning ring 54 extends axially here from the bypass device 45 as far as one of the axial ends 42, 44. The lower positioning ring 54 in FIG. 5 is supported here axially on the first face side wall 73 of the plunger stop 20. The upper positioning ring 54 in FIG. 5 is supported here axially on the second face side wall 74 of the housing 19.

Figure 6:
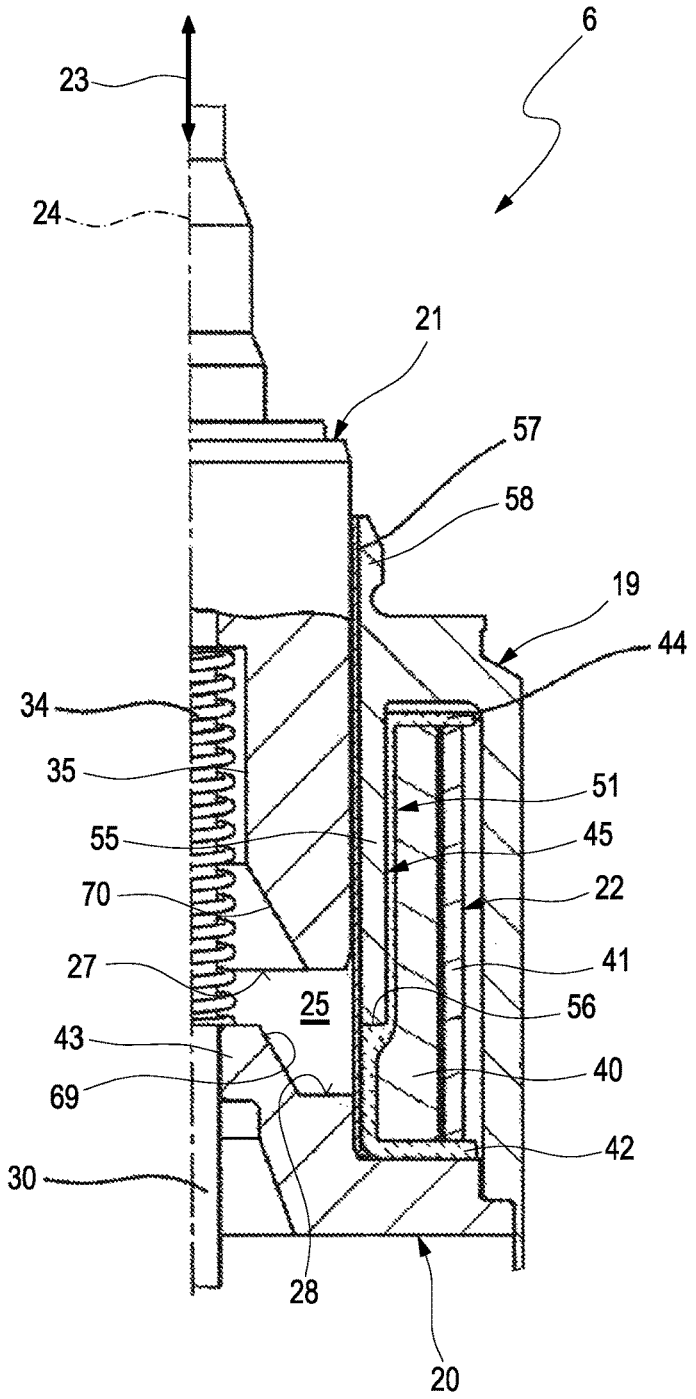

In the embodiment shown in FIG. 6, the bypass device 45 is formed by a sleeve-shaped, cylindrical section 55 of the housing 19, and therefore the bypass device 45 thus forms an integral component of the housing 19. At the second axial end 44, said cylindrical sleeve section 55 extends coaxially into the coil interior space 25 and ends axially spaced apart from the plunger stop 20. The coil carrier 51 is provided here with an annular step 56 which substantially corresponds to the continuous receiving region 52 of the embodiment shown in FIG. 3. In the example of FIG. 6, the annular step 56 serves to plug the coil arrangement 22 or the coil carrier 51 axially onto the cylindrical component 55 of the housing 19. In this embodiment the bypass device 45 or the cylindrical sleeve section 55, respectively, limits radially the coil receiving chamber 72.

Figure 7:
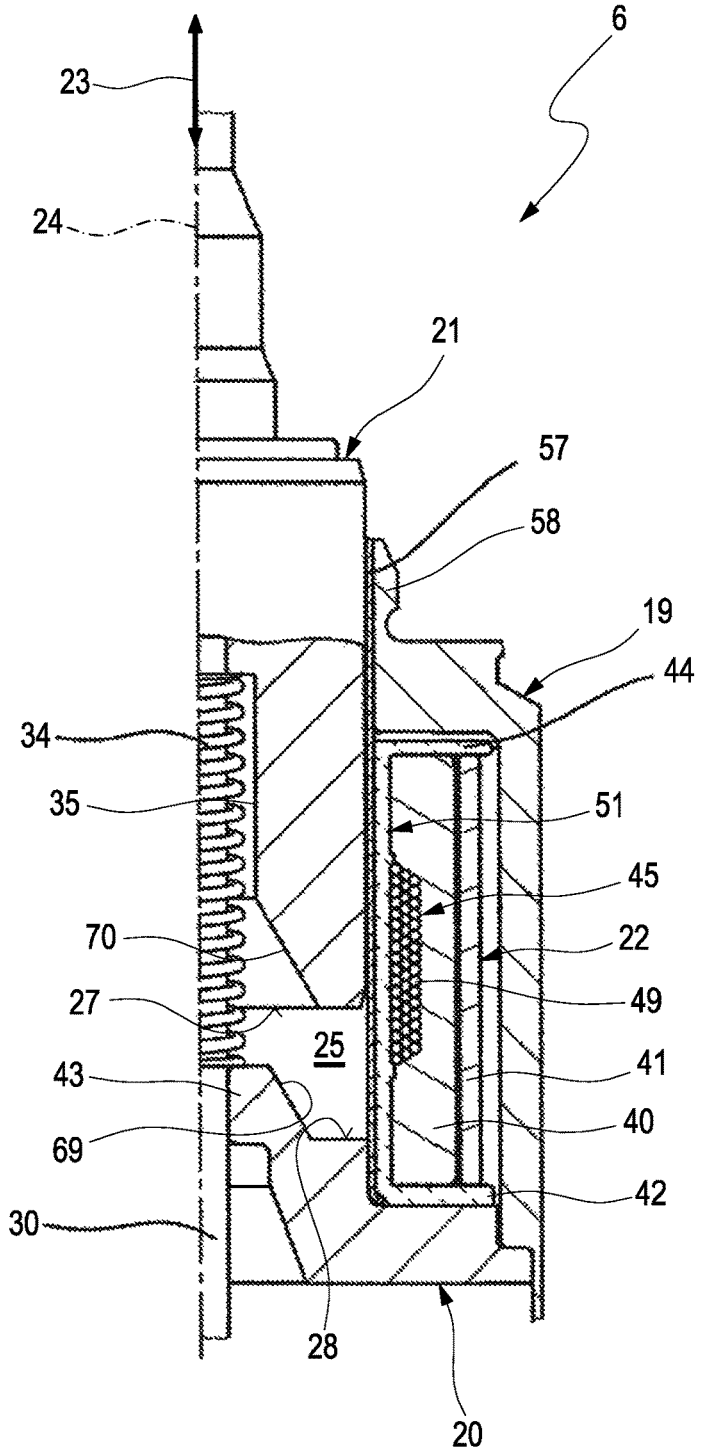
Figure 8:
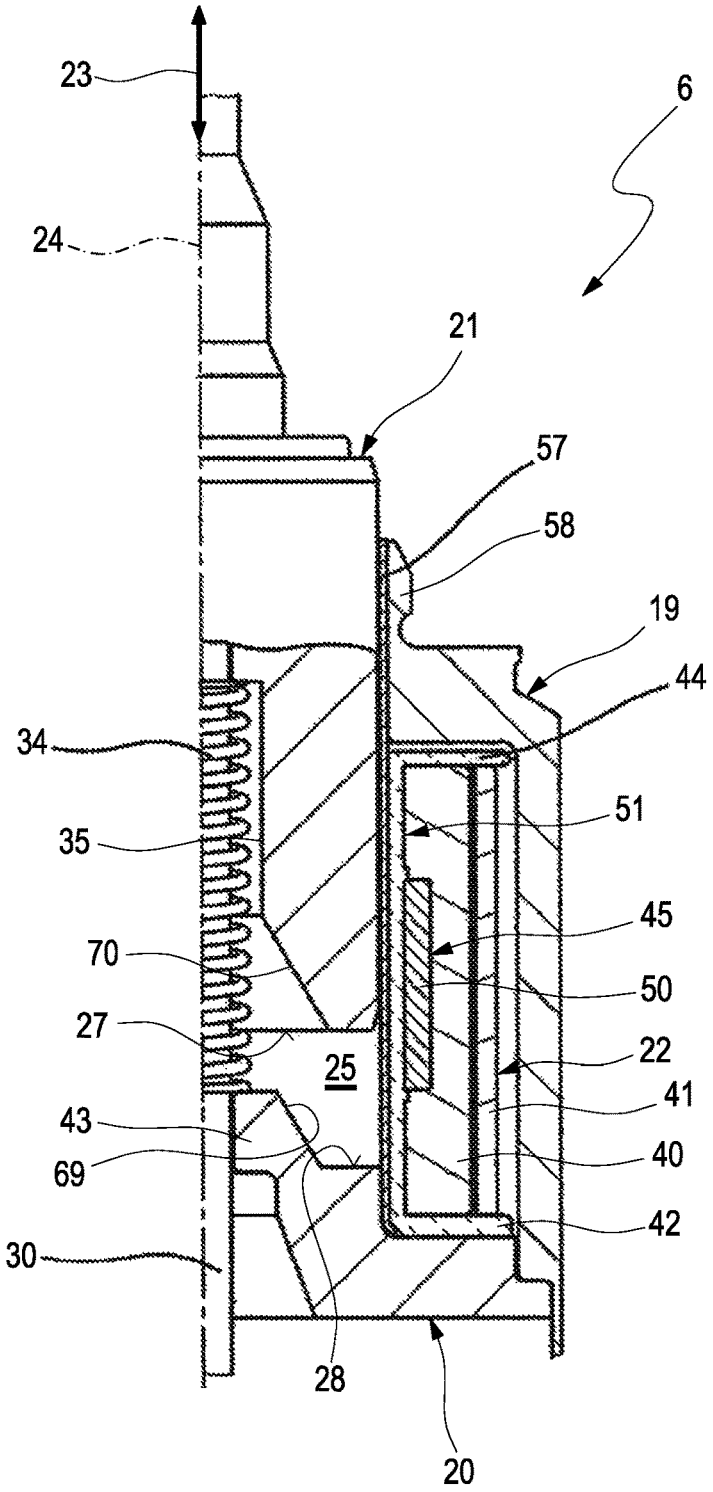

In the examples of FIGS. 7 and 8, the bypass device 45 is integrated in the coil arrangement 22. The bypass device 45 is arranged here on a radial outer side of the coil carrier 51. In the embodiment shown in FIG. 7, the ferromagnetic winding 49 of the bypass device 45 is first of all wound onto the coil carrier 51, onto which the retraction coil 40 is then wound, followed by the holding coil 41.

In the example of FIG. 8, the in particular rod-shaped or circumferential-segment-shaped bypass elements 50 are arranged on the radially outer side of the coil carrier 51 and are fixed there, for example, by the retraction coil 40 being wound on. In principle, according to FIG. 8, an unsegmented or undivided annular bypass device 45 may also be arranged on the radially outer side of the coil carrier 51. For this purpose, a plastics coil carrier 51 can be injected onto said bypass device 45. It is also conceivable to segment the bypass device 45 in the circumferential direction and to subsequently fit the individual segments onto the coil carrier 51.

According to the examples of FIGS. 2 to 9 and 14 and 15, the solenoid drive 6 is expediently provided with a cylindrical guide sleeve 57 which is arranged coaxially on the inside of the coil arrangement 22 and which extends from the first axial end 42 through the coil interior space 25 and beyond the second axial end 44 into a guide region 58 of the housing 19. The plunger 21 passes through said guide region 58. The plunger 21 is guided in an axially adjustable manner radially on the outside of said guide sleeve 57. Said guide sleeve 57 is expediently produced from a non-magnetic material. For example, a low-friction plastic is used.

Figure 9:
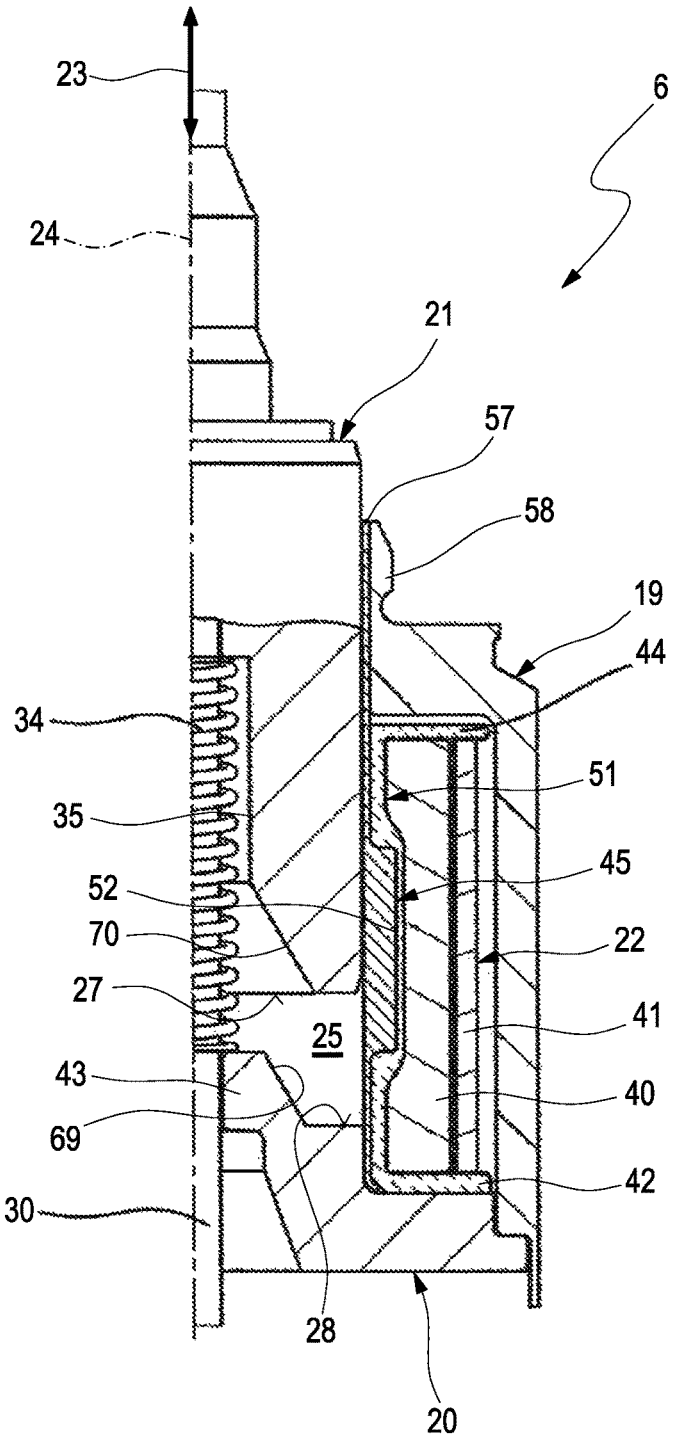

In the embodiment shown in FIG. 9, the guide sleeve 57 is by contrast produced from a ferromagnetic material. Furthermore, provision is made here to form the bypass device 45 by an integral component of said guide sleeve 57. The guide sleeve 57 is discernibly provided with a greater wall thickness in the radial direction in the region of the bypass device 45, as a result of which the desired deflecting effect for magnetic field lines is produced there. It is also basically conceivable here to spray the plastics coil carrier 51 onto the outer side of the guide sleeve 57. Furthermore, it is conceivable to segment the guide sleeve 57 or the coil carrier 51 in the circumferential direction.

Figure 10:
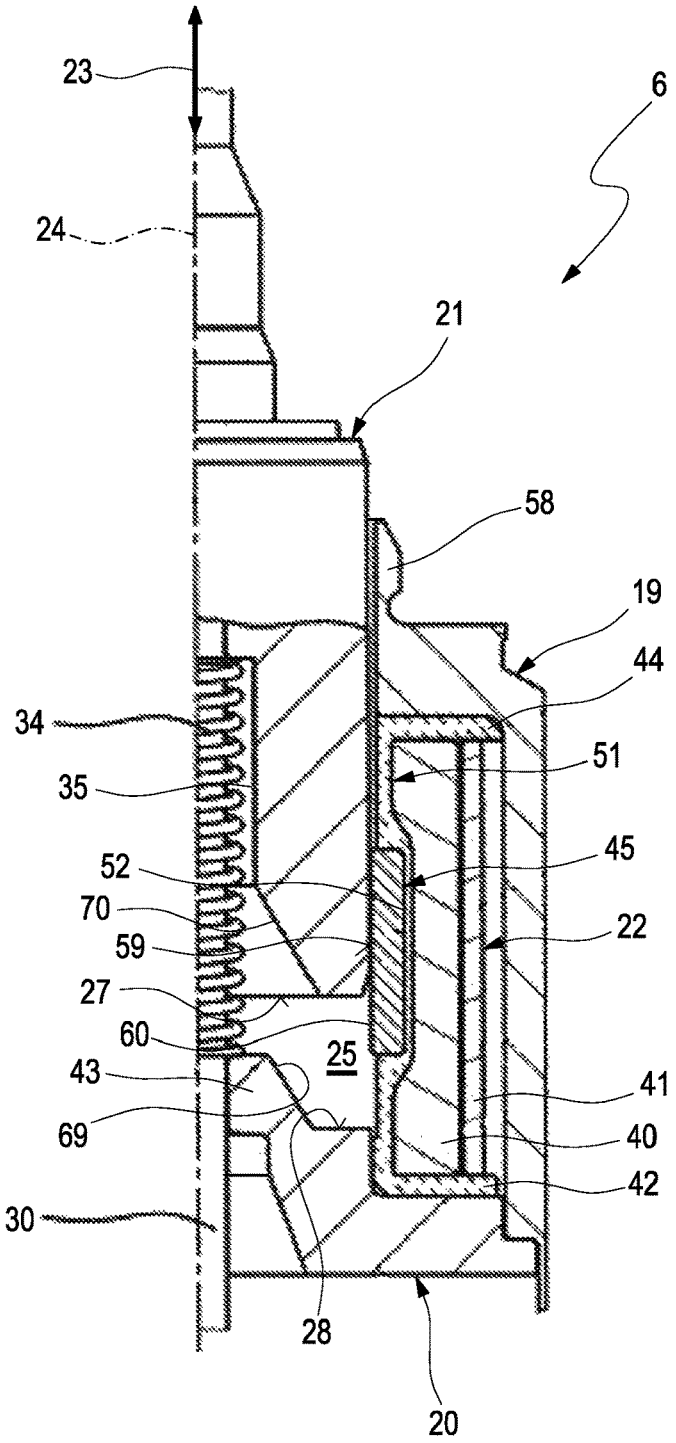

In the embodiments of FIGS. 10 to 13, a separate guide sleeve 57 is omitted. In the example of FIG. 10, the bypass device 45 is provided radially on the inside with a cylindrical guide contour 59 on which the plunger 21 is guided in an axially adjustable manner radially on the outside. It is basically possible here to guide the plunger 21 radially on the outside directly on the bypass device 45. However, the bypass device 45 is preferably provided radially on the inside with a low-friction coating 60, for example made from Teflon.

Figure 11:
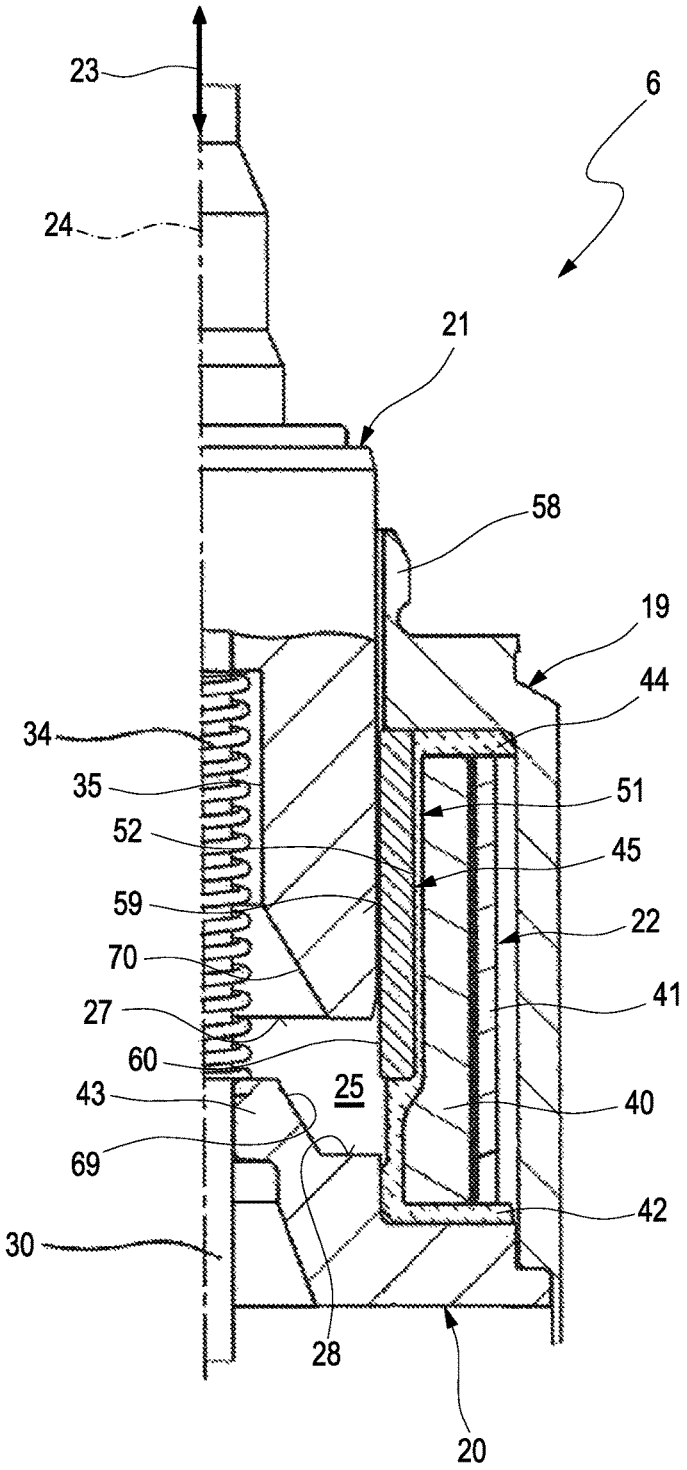
Figure 12:
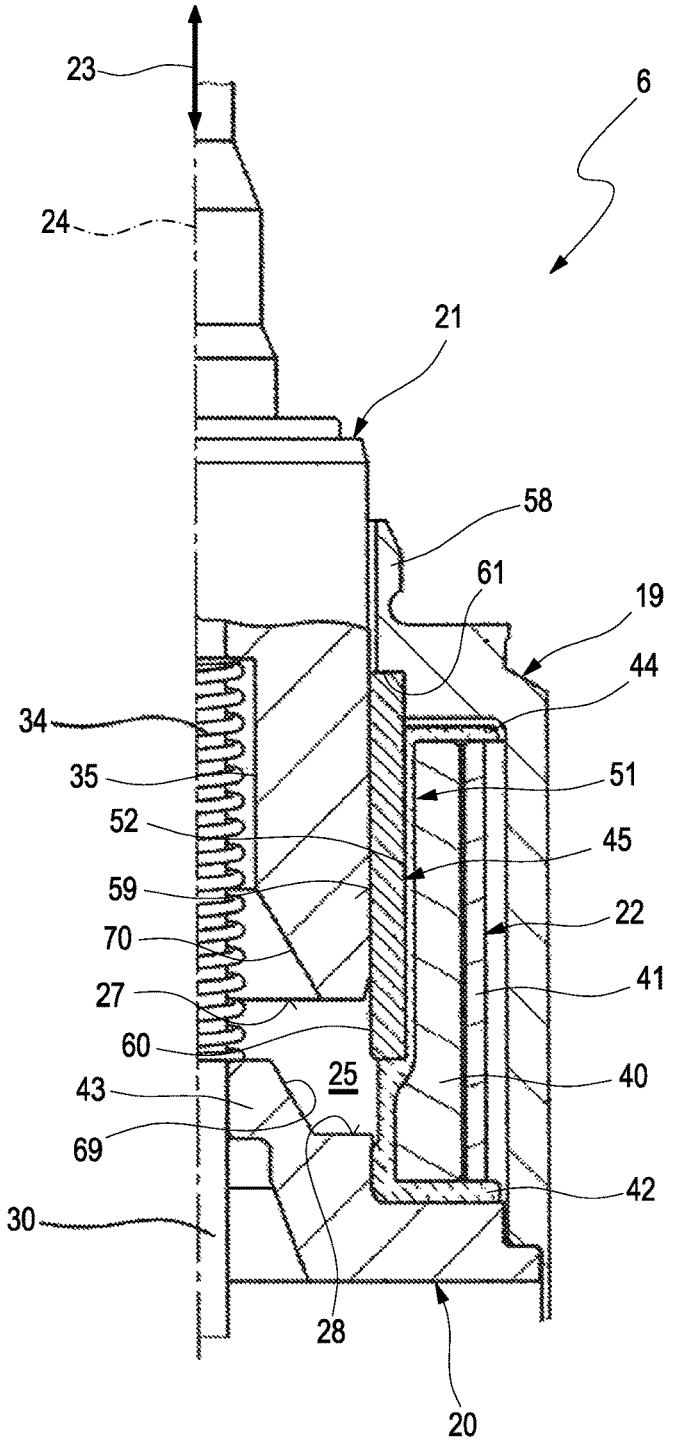

Also in the examples of FIGS. 11 and 12, the bypass device 45 is provided radially on the inside with a guide contour 59 of this type which optionally can likewise be realised with the aid of a low-friction coating 60 of this type. While, in the example of FIG. 10, the bypass device 45 is spaced apart axially from the two axial ends 42, 44, in the examples of FIGS. 11 and 12 the bypass device 45 extends in each case as far as the second axial end 44. In the example of FIG. 11, the bypass device 45 is supported axially in the region of the second axial end 44 on the housing 19. In the example of FIG. 12, the bypass device 45 extends axially beyond the second axial end 44 and is supported on the housing 19 in an annular step 61.

Figure 13:
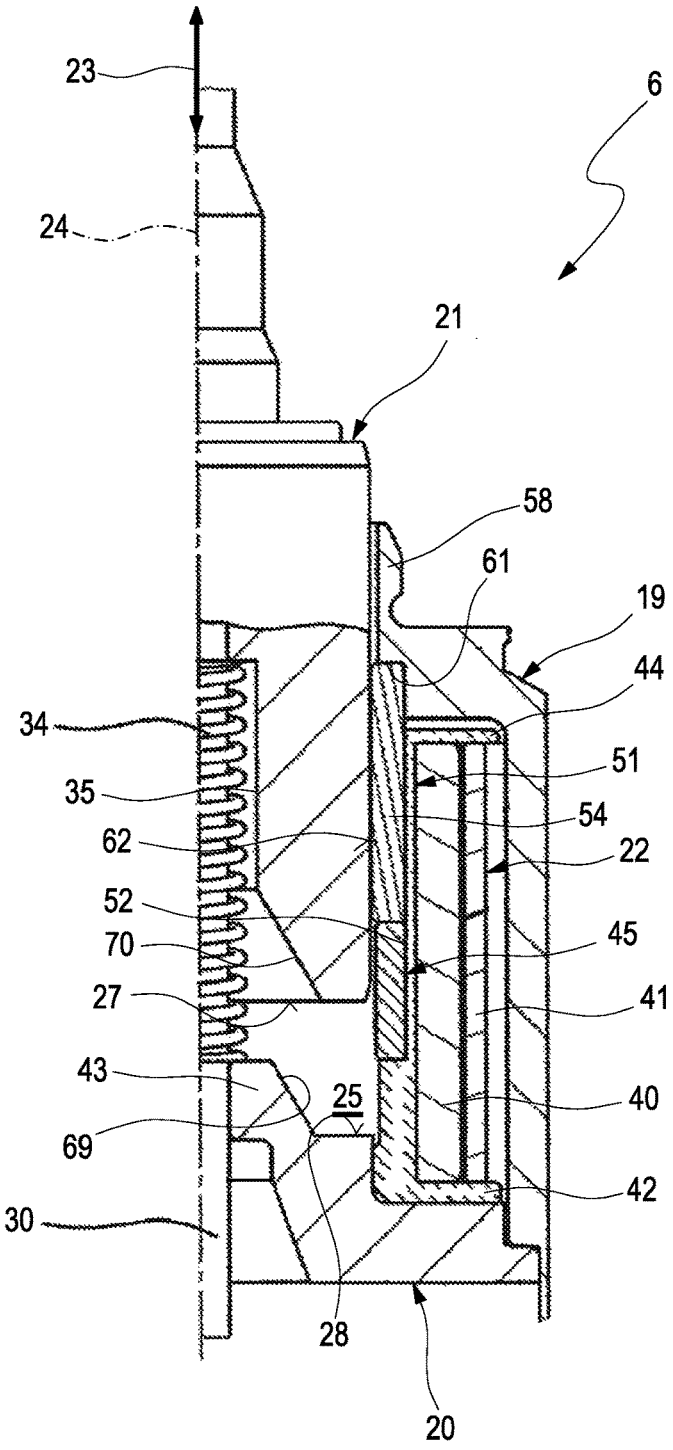

In the embodiment shown in FIG. 13, similarly as in the embodiment shown in FIG. 3, a non-magnetic positioning ring 54 is provided for the axial positioning of the bypass device 45, said positioning ring, similarly as in FIG. 12, being supported purely by way of example in an annular step 61 of the housing 19. In this embodiment, the positioning ring 54 is provided radially on the inside with a cylindrical guide contour 62 on which the plunger 21 is guided in an axially adjustable manner radially on the outside. A low-friction, tribologically optimised combination of material can be realised by an appropriate selection of material for the positioning ring 54.

Figure 14:
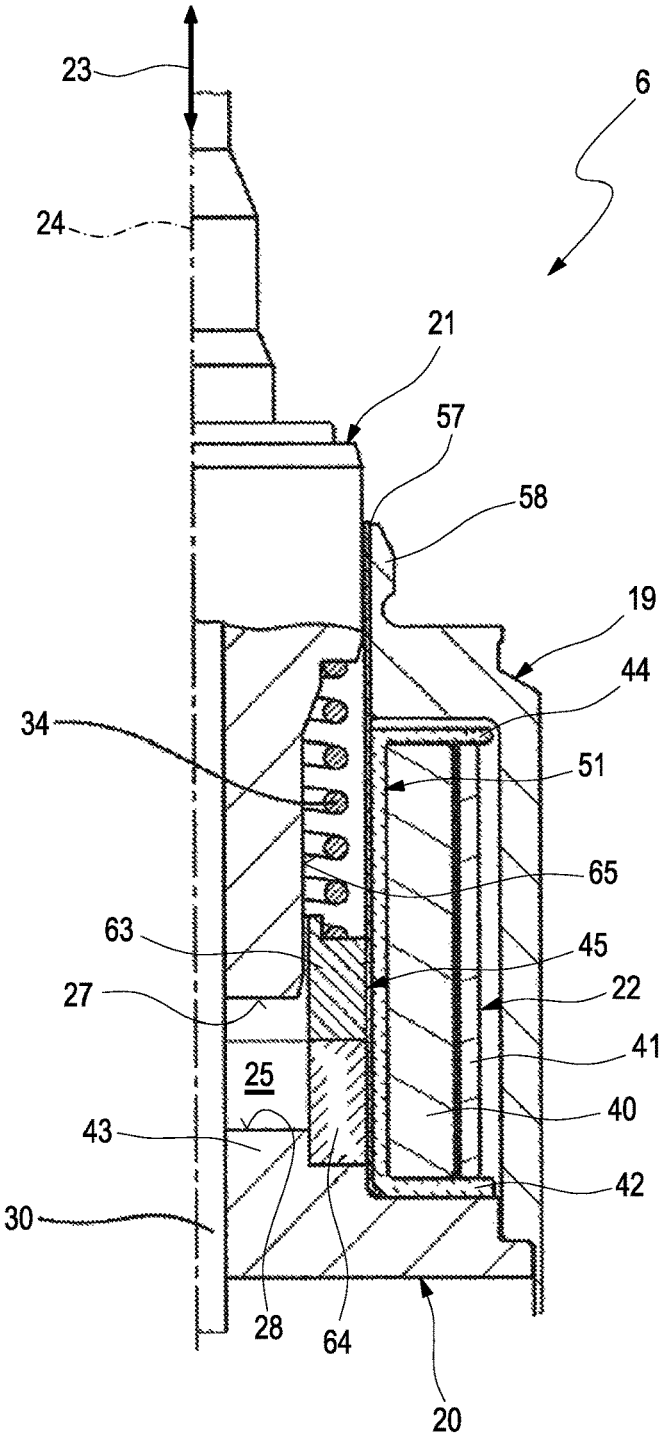
Figure 15:
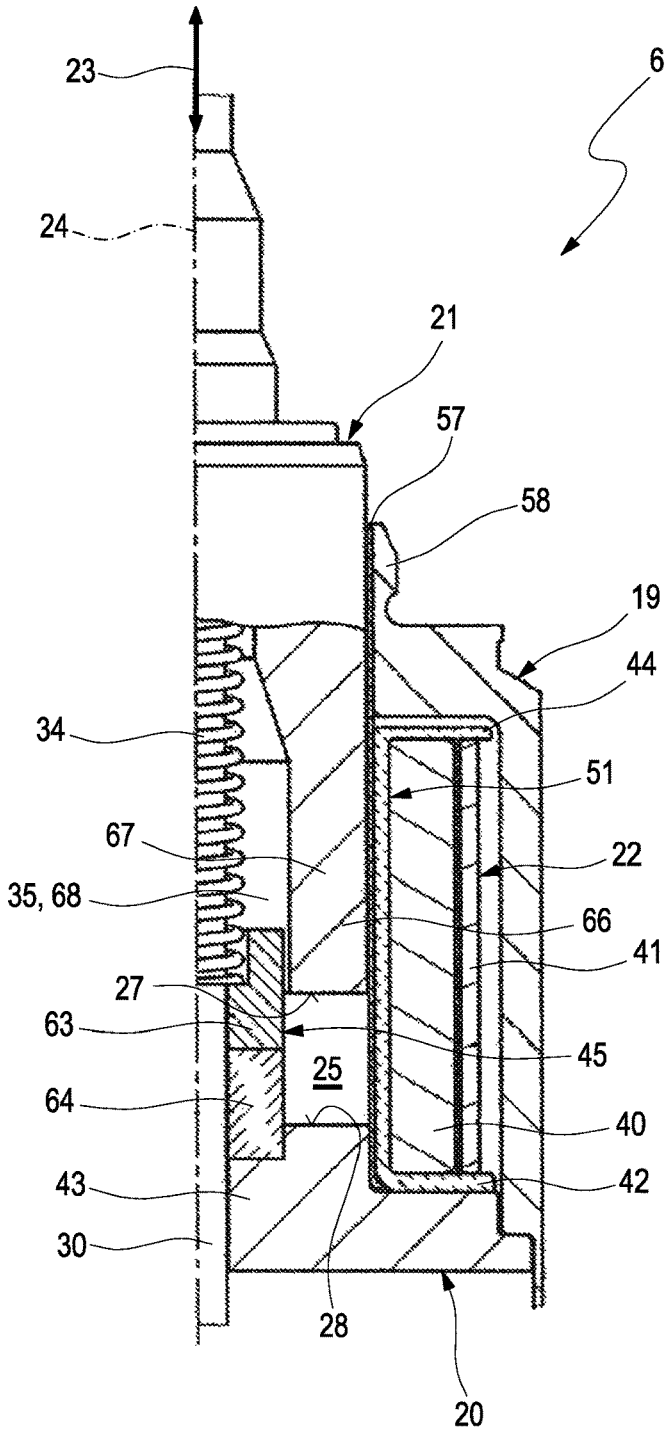

In the embodiments of FIGS. 14 and 15, the bypass device 45 is arranged in the coil interior space 25. The bypass device 45 is located here radially within the coil arrangement 22, radially within the coil carrier 51 and, in the example, also radially within the guide sleeve 57. Furthermore, the bypass device 45 has a cylindrical and ferromagnetic deflecting body 63 which is supported axially on the central region 43 of the plunger stop 20 via a cylindrical and non-magnetic spacer body 64.

In the example of FIG. 14, the deflecting body 63 and the spacer body 64 are positioned bearing radially on the inside of the guide sleeve 57 and also are of hollow-cylindrical or annular design. With regard to an external contour 65 of the plunger 21, the latter can be arranged with a radial gap with respect to the deflecting body 63 and with respect to the spacer body 64. Accordingly, in the passive position PS, the plunger 21 protrudes axially into the deflecting body 63. In the active position AS, the plunger 21 protrudes through the deflecting body 63 axially into the spacer body 64. In the example of FIG. 14, deflecting body 63 and spacer body 64 are therefore located radially on the outside of the plunger 21.

In the embodiment shown in FIG. 15, the plunger 21 is of hollow-cylindrical design at least in an end region 66 facing the central region 43 of the plunger stop 20, and therefore the plunger 21 in said end region 66 has a plunger wall 67 which encloses a plunger interior space 68 in the circumferential direction. That plunger interior space 68 corresponds to the cavity 35 already mentioned further above. Deflecting body 63 and spacer body 64 are now arranged radially on the inside with respect to the plunger wall 67, but are spaced apart radially therefrom. In the passive position PS, only the deflecting body 63 protrudes axially into the plunger interior space 68. In the active position AS, the deflecting body 63 and the spacer body 64 protrude axially into the plunger interior space 68.

In the examples of FIGS. 14 and 15, the restoring spring 34 which drives the plunger 21 into the passive position PS is supported on the deflecting body 63. In the two examples, deflecting body 63 and spacer body 64 are of annular design in order at any rate to be able to pass the actuating rod 30 coaxially therethrough.

The embodiments shown in FIGS. 14 and 15 are suitable in a particular way for retrospective integration of the bypass device 45 in an otherwise conventional solenoid drive 6. In this case, the solenoid drive 6 can be retrofitted or realised in a particularly simple manner.

In the examples of FIGS. 2 to 13, the central region 43 is provided with a central conical or frustoconical extension 69 which tapers along the longitudinal central axis 24 in the direction of the plunger 21. The plunger 21 has, on the plunger end side 27 thereof, a conical depression 70 which is complementary with respect to the extension 69 and into which the extension 69 protrudes axially during the transfer into the active position AS.

The invention claimed is:

1. A solenoid drive for a starter, comprising:

a ferromagnetic housing having a coil receiving chamber, the coil receiving chamber having a central axis and being axially limited by a first face side wall and an opposing second face side wall;

a cylindrical coil arrangement having at least one electric coil, and being arranged in the coil receiving chamber coaxially to the central axis, and coaxially surrounding a cylindrical coil interior space;

a ferromagnetic plunger stop having a central region projecting axially into the coil interior space;

a ferromagnetic plunger arranged at the housing opposing the plunger stop, the plunger projecting axially into the coil interior space, and being adjustable axially bi-directionally along the central axis relative to the housing between an active position, which is proximal with respect to the central region, and a passive position, which is distal with respect to the central region; and a ferromagnetic bypass device arranged coaxially with respect to the coil arrangement, radially within the at least one coil, and spaced apart axially in a direction of the central axis from the first face side wall, the second face side wall, and both axial ends of the coil arrangement such that a magnetic field between the plunger and plunger stop is diverted directly from the plunger to the plunger stop via the bypass device;

wherein the coil arrangement includes a cylindrical coil carrier onto which the at least one coil is wound radially on an outside thereof; and wherein the coil carrier has, radially on an inside thereof, a receiving region in which the bypass device is arranged such that the plunger does not extend beyond the bypass device in a direction of the central region when in the passive position and at least a portion of the plunger is adjustable beyond the bypass device in the direction of the central region.

2. The solenoid drive according to claim 1, wherein at least one of:

the bypass device is at a respective axial distance from the first and second face side walls, the axial distance being at least 20% of an axial length of the coil receiving chamber; and the bypass device is arranged substantially centrally axially with respect to the first and second face side walls.

3. The solenoid drive according to claim 1, wherein:

the receiving region extends axially as far as an axial end of the coil arrangement, wherein the bypass device is positioned axially in the receiving region by a non-magnetic positioning ring extending from the bypass device as far as said axial end of the coil arrangement.

4. The solenoid drive according to claim 3, wherein: the positioning ring has, radially on an inside thereof, a cylindrical guide contour on which the plunger is guided in an axially adjustable manner radially on an outside thereof.

5. The solenoid drive according to claim 1, wherein:

the bypass device is arranged between two positioning rings each extending from the bypass device as far as an axial end of the coil arrangement.

6. The solenoid drive according to claim 1, wherein:

the bypass device is formed by an integral component of the housing, wherein the component is cylindrical and extends coaxially into the coil interior space at an axial end of the coil arrangement.

7. The solenoid drive according to claim 6, wherein:

the coil carrier has an annular step with which said coil carrier is plugged axially onto the bypass device.

8. The solenoid drive according to claim 1, wherein:

the bypass device has at least one winding made or formed from a ferromagnetic wire.

9. The solenoid drive according to claim 1, wherein:

the bypass device has a plurality of ferromagnetic bypass elements distributed in a circumferential direction.

10. The solenoid drive according to claim 1, wherein:

the plunger is guided in an axially adjustable manner radially on an outside of a cylindrical guide sleeve, which is arranged coaxially on an inside of the coil arrangement and which extends from a first axial end of the coil arrangement through the coil interior space and beyond a second axial end of the coil arrangement into a guide region of the housing through which the plunger passes;

the guide sleeve is composed of a ferromagnetic material; and the bypass device is formed by an integral component of the guide sleeve.

11. The solenoid drive according to claim 1, wherein:

the bypass device has, radially on an inside thereof, a cylindrical guide contour on which the plunger is guided in an axially adjustable manner radially on an outside thereof.

12. The solenoid drive according to claim 1, wherein:

the bypass device has, in the coil interior space, a ferromagnetic deflecting body supported axially on the central region of the plunger stop via a non-magnetic spacer body.

13. The solenoid drive according to claim 12, wherein one of:

the deflecting body and the spacer body are of annular design and are arranged in the coil interior space radially on an outside with respect to the plunger; or the plunger is of hollow-cylindrical design at least in an end region facing the central region of the plunger stop and has a cylindrical plunger wall enclosing a plunger interior space, wherein the deflecting body and the spacer body are arranged radially on an inside with respect to the plunger wall.

14. A solenoid drive for a starter, comprising:

a ferromagnetic housing having a coil receiving chamber, the coil receiving chamber having a central axis and being axially limited by a first face side wall and an opposing second face side wall;

a cylindrical coil arrangement having at least one electric coil, and being arranged in the coil receiving chamber coaxially to the central axis, and coaxially surrounding a cylindrical coil interior space;

a ferromagnetic plunger stop having a central region projecting axially into the coil interior space;

a ferromagnetic plunger arranged at the housing opposing the plunger stop, the plunger projecting axially into the coil interior space, and being adjustable axially bi-directionally along the central axis relative to the housing between an active position, which is proximal with respect to the central region, and a passive position, which is distal with respect to the central region; and a ferromagnetic bypass device arranged coaxially with respect to the coil arrangement, radially within the at least one coil, and spaced apart axially in a direction of the central axis from the first face side wall, the second face side wall, and both axial ends of the coil arrangement;

wherein the plunger is adjustable beyond the second face side wall such that at least a portion of the plunger extends outside of the housing;

wherein the coil arrangement includes a cylindrical coil carrier onto which the at least one coil is wound radially on an outside thereof; and wherein the coil carrier has, radially on an inside thereof, a receiving region in which the bypass device is arranged such that the plunger does not extend beyond the bypass device in a direction of the central region when in the passive position and at least a portion of the plunger is adjustable beyond the bypass device in the direction of the central region.

* * * * *